US005754924A

United States Patent [19]

Yamada

[11] Patent Number: 5,754,924

[45] Date of Patent: May 19, 1998

[54] IMAGE PROCESSING APPARATUS AND COPYING APPARATUS

[75] Inventor: Masanori Yamada, Inagi, Japan

[73] Assignee: Canon Kabushiki Kaisha, Tokyo, Japan

[21] Appl. No.: 735,208

[22] Filed: Oct. 22, 1996

Related U.S. Application Data

[63] Continuation of Ser. No. 373,842, Jan. 8, 1995, abandoned.

[30] Foreign Application Priority Data

Jan. 21, 1994 [JP] Japan ..... 6-005299

[51] Int. Cl.[6] ..... G03G 21/00

[52] U.S. Cl. ..... 399/81; 399/39

[58] Field of Search ..... 399/81, 39; 345/112, 345/113, 115, 119, 123, 145

[56] References Cited

U.S. PATENT DOCUMENTS

| | | | |
|---|---|---|---|
| 5,045,880 | 9/1991 | Evanitsky et al. | 355/209 X |
| 5,061,958 | 10/1991 | Bunker et al. | 355/209 |
| 5,105,220 | 4/1992 | Knodt et al. | 355/209 |
| 5,113,222 | 5/1992 | Wilson et al. | 355/209 X |
| 5,185,628 | 2/1993 | Wilson et al. | 355/209 |
| 5,442,541 | 8/1995 | Hube et al. | 364/138 |
| 5,493,349 | 2/1996 | Ikeda | 358/518 |

FOREIGN PATENT DOCUMENTS 3123274 5/1991 Japan .

*Primary Examiner*—Matthew S. Smith

*Attorney, Agent, or Firm*—Fitzpatrick, Cella, Harper & Scinto

[57] ABSTRACT

Image processing apparatus and copying apparatus enhance the operability of color adjusting function. A plurality of image processing menus including modifying word representing contents of the image processings are concurrently displayed, and an adjustment state is displayed in a selected one of the displayed menus.

29 Claims, 14 Drawing Sheets

| FIG. 2A | FIG. 2B |
|---|---|

IMAGE PROCESSING APPARATUS AND COPYING APPARATUS

This application is a continuation of application Ser. No. 08/373,842, filed Jan. 18, 1995, now abandoned.

BACKGROUND OF THE INVENTION

1. Field of the Invention

The present invention relates to image processing apparatus and copying apparatus capable of concurrently displaying a plurality of image processing menus.

2. Related Background Art

A color copying apparatus has been dramatically improving its performance in terms of reproduciability of color as the digital technique has been introduced, and its market area has been expanded. In a color copying apparatus, a function to adjust the color is important in two major objectives. The first objective is to finish a reproduced output in the same color as that of an original and a second objective is to finish it in a desired color. The color adjustment in the color copying apparatus is attained by adjusting developing agents such as toners and inks, that is, by adjusting a composition of magenta, cyan and yellow as well as black in some cases.

However, the color adjustment by the composition of the developing agents is very difficult for general users. For example, red consists of magenta and yellow, and when a reproduced output is somewhat more reddish than the color of the original or the desired color, proportions of magenta and yellow of the three or four color developing agents should be reduced to suppress the red. In some cases, the proportion of cyan is increased. Such adjustment cannot be well carried out except a professional of printing art or an expert of color processing.

SUMMARY OF THE INVENTION

It is an object of the present invention to provide image processing apparatus and copying apparatus which intend to solve the above problems.

It is another object of the present invention to provide high operability image processing apparatus and copying apparatus.

In order to achieve the above object, the present invention provides an image processing apparatus comprising first display means for concurrently displaying a plurality of image processing menus including modifying words representing contents of image processing, and second display means for displaying an adjustment state in a selected one of the menus displayed on the first display means.

It is another object of the present invention to provide image processing apparatus and copying apparatus capable of fine adjustment by setting particular adjustment processings by titles which are easy to recognize for the user and displaying adjustment states for the respective processings.

It is other object of the present invention to provide image processing apparatus and copying apparatus having a new function.

Other objects and features of the present invention will be apparent from the description and drawings of the preferred embodiments.

DETAILED DESCRIPTION OF THE PREFERRED EMBODIMENTS

One embodiment of the present invention is now explained in detail with reference to the drawings.

In the present embodiment, a color image forming apparatus is explained although it should be understood that the present invention is applicable to not only the color image forming apparatus but also to any apparatus having an image such as a television and a television-telephone.

Figure 1:
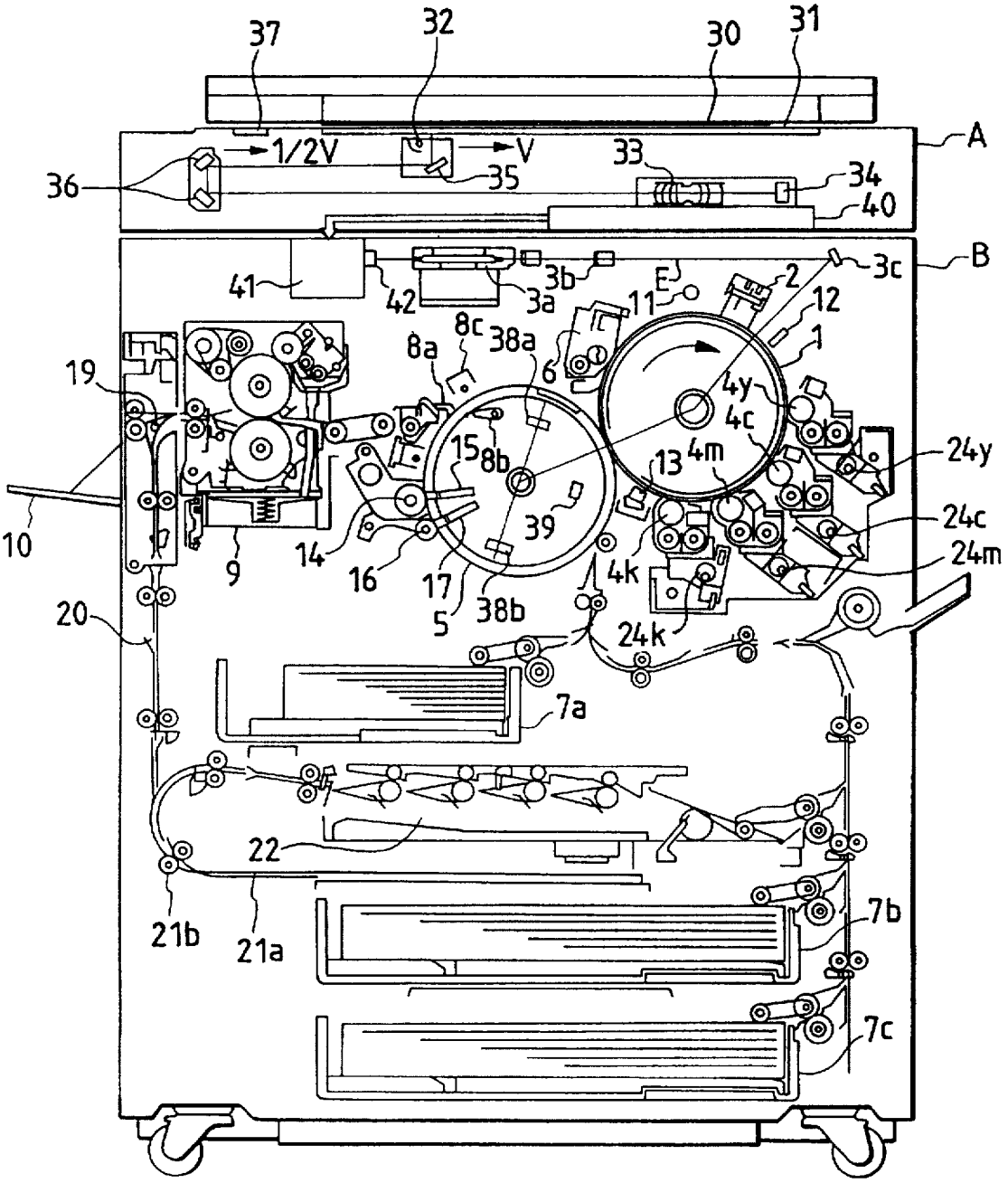
FIG. 1 shows a configuration of a color image recording apparatus in accordance with one embodiment of the present invention.

FIG. 1 shows a sectional view of the color image forming apparatus of the present embodiment.

The color image forming apparatus of the present embodiment has a digital color image reader unit A at the top and a digital color image printer unit B at the bottom.

In the reader unit, an original (a document sheet) 30 is mounted on a document sheet table 31 and it is scanned and exposed by an exposure lamp 32, and a reflected light image from the original 30 is sensed by a full color sensor 34 through a lens 33 and mirrors 35 and 36 to produce color decomposed image signals, which are applied to an image processing circuit 40 through an amplifier (not shown) and processed signals are sent to the printer unit.

In the printer unit, a photoconductor drum 1 which is an image carrier is carried rotatably in a direction of an arrow, and a pre-exposure lamp 11, a corona discharger 2, a laser exposure optical system comprising (a polygon mirror 3*a*, a lens 3*b* and a mirror 12, a potential sensor 12, four developing units 4Y, 4C, 4M and 4K of different colors, an on-drum light intensity detector 13, a transfer drum 5 and a cleaning unit 6 are arranged around the photoconductor drum 1.

In the laser exposure optical system 3, the image signals from the reader unit are converted to light signals by a laser output unit 41 and the laser light outputted from the laser 42 is reflected by the polygon mirror 3*a* and passes through the lens 3*b* and the mirror 3*c* and projected to the photoconductor drum 1.

When an image is to be formed in the printer unit, the photoconductor drum 1 is rotated in the direction of arrow and the photoconductor drum discharged by the pre-exposure lamp 11 is uniformly charged by the charger 2 and a light image E is irradiated for each decomposed color to form a latent image.

A predetermined developing unit is operated to develop the latent image on the photoconductor drum 1 and a resin-based toner image is formed on the photoconductor drum 1. The developing unit is selectively approached to the photoconductor drum 1 for each decomposed color by the operation of eccentric cams 24Y, 24C, 24M and 24K.

The toner image on the photoconductor drum is transferred to a recording medium supplied from a recording medium cassette to a position facing the photoconductor drum 1 through a transport unit and the transfer unit 5. The transfer drum 5 is rotatably supported and a recording medium carrying sheet made of a dielectric material is arranged in a peripheral opening area. As the transfer drum 5 is rotated, a desired number of color images of the toner image on the photoconductor drum 1 are transferred to the recording medium carried by the recording medium carrying sheet by the charger and the roller (not shown) to form a full color image.

In the full color image formation, when the four color toner images have been transferred, the recording medium is separated from the transfer drum 5 by the action of a separation pawl 8*a*, a separating push-up roll 8*b* and a separating charger 8*c*, and it is ejected to a tray 10 through a heat roller fixing unit 9.

On the other hand, after the transfer, the photoconductor drum 1 has residual toner on the surface thereof cleaned by the cleaning unit 6 in preparation for a subsequent image forming process.

When images are to be formed on both sides of the recording medium, a transport path switching guide 19 is driven immediately after the ejection of the recording medium from the fixing unit 9 to temporarily guide the recording medium to a reverse path 21*a* through a transport longitudinal path 20, and when the reverse roller 21*b* is reversed, the recording medium is transported in the opposite direction to the feed-in direction with the trailing edge when it was fed in being a leading edge and the recording medium is accommodated in an intermediate tray 22. Thereafter, the image is formed on the other side by the image forming process.

In order to prevent the flying deposition of particles on the recording medium carrying sheet of the transfer drum 5 and the deposition of oil on the recording medium, they are cleaned by the action of a fur brush 14, a backup brush 15 facing the brush 14 with the recording medium carrying sheet interposed therebetween, an oil elimination roller 16 and a backup brush 17 facing the roller 16 with the recording medium carrying sheet interposed therebetween. The cleaning is carried out either before or after the image formation, and any time when jam occurs.

Numeral 39 denotes an image leading edge sensor. When signal plates 38*a* and 38*b* cross the sensor 39, an image leading edge signal ITOP is generated. The plates 38*a* and 38*b* are spaced by 180 degrees so that two ITOP signals are generated in one revolution of the transfer drum 5.

Figures 2, 2A:
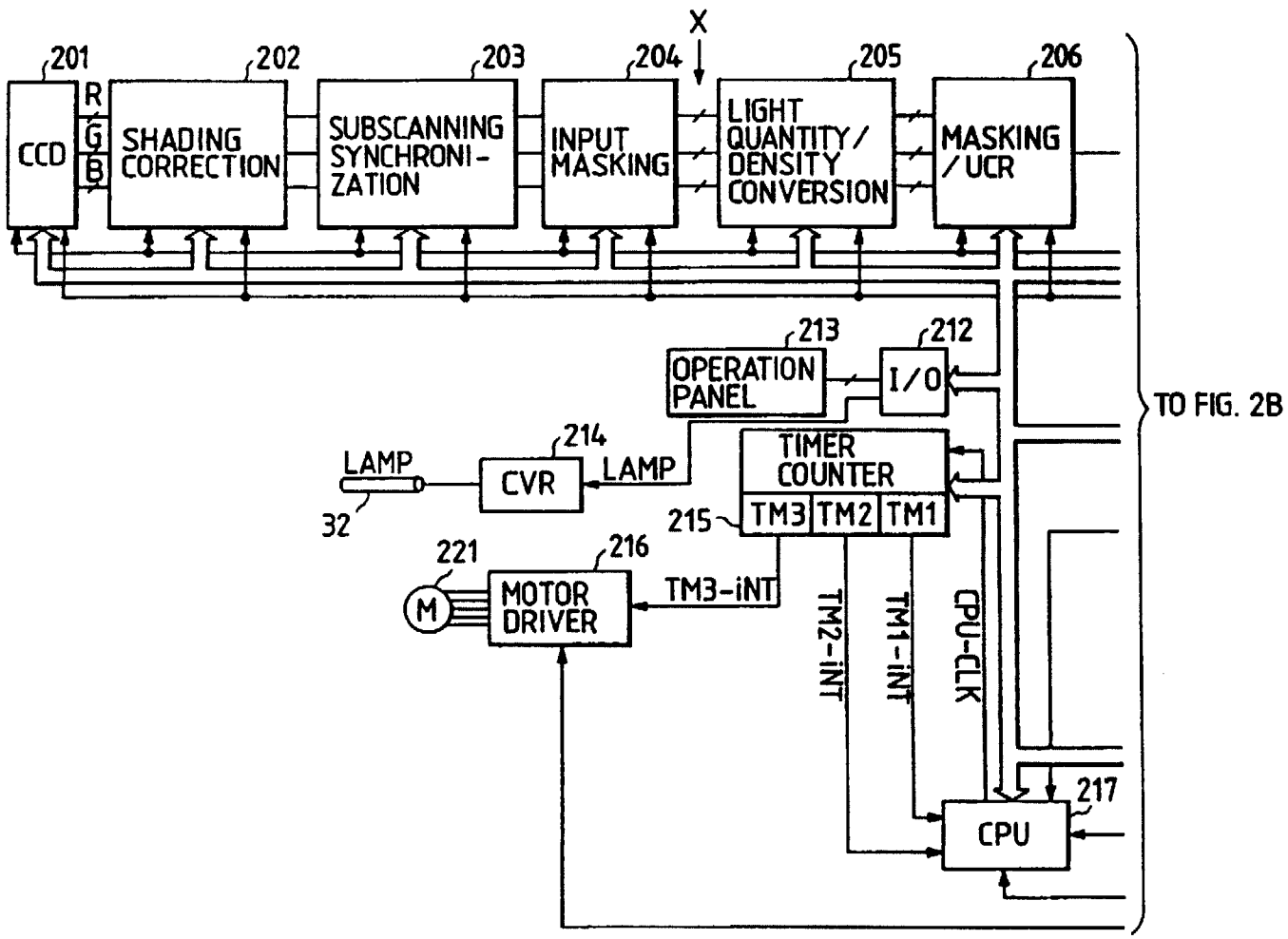
FIG. 2 is comprised of FIGS. 2A and 2B showing block diagrams of an image processing circuit.
Figure 2B:
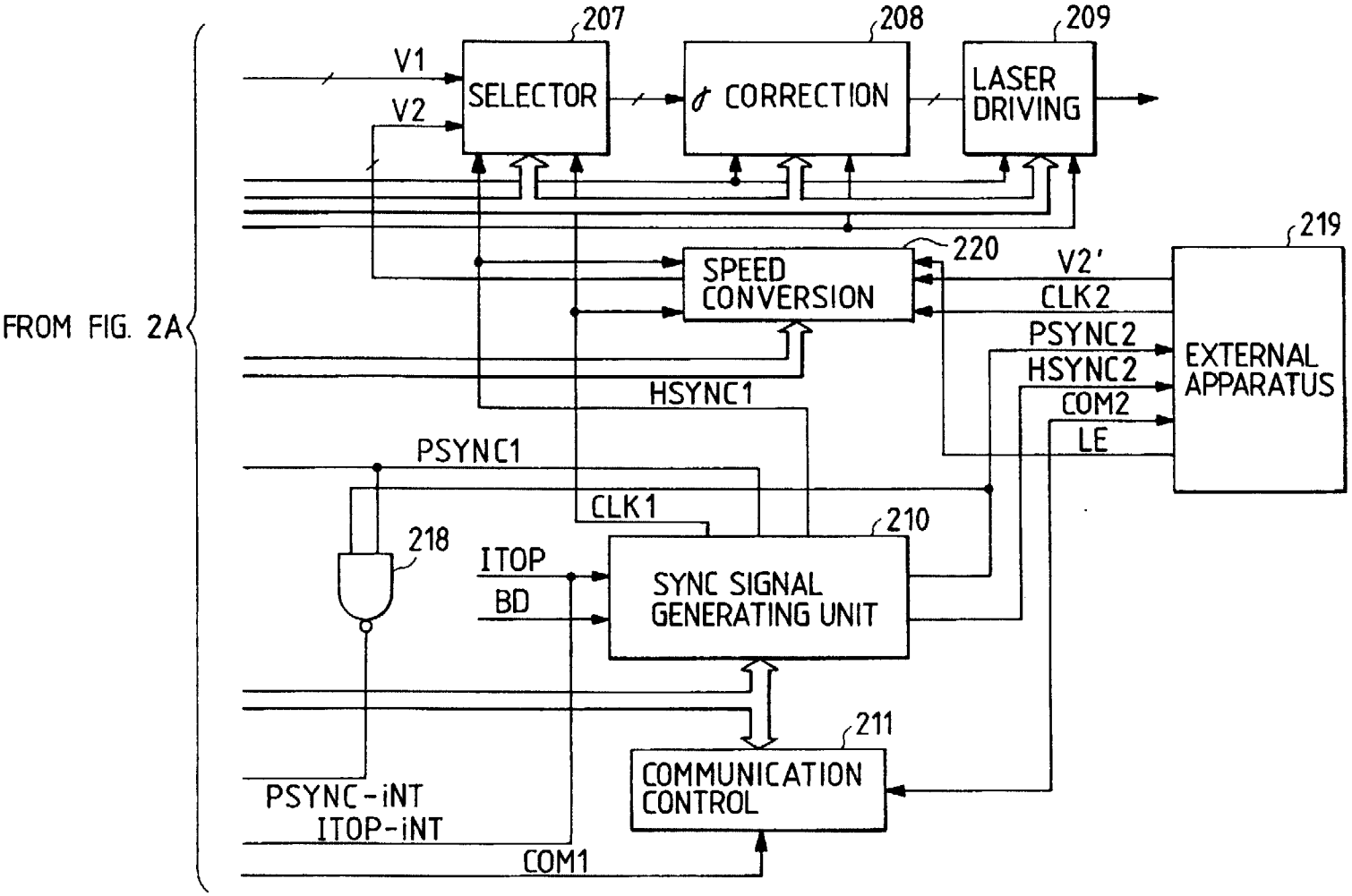

FIGS. 2A and 2B show block diagrams of a flow of the image signal in the image processing circuit 40. The image signal which is photo-electrically converted by the CCD 34 of FIG. 1 is gain-controlled and offset-controlled in a CCD processing unit 201 and converted to 8-bit digital image signals R, G and B for each color signal by an A/D converter. Then, it is applied to a shading correction unit 202 which applies known shading correction by using a read signal of a standard white plate 37 shown in FIG. 1 for each color.

Since a sensing portions of the CCD 34 are arranged with a predetermined space between R, G and B, a space shift in a sub-scan direction is corrected by a sub-scan synchronization processing unit 203 comprising line delay elements.

Numeral 204 denotes an input masking unit which corrects the turbidity of the R, G and B filters. Numeral 205 denotes a light quantity/density conversion unit which comprises a lookup table ROM (or RAM) and converts the R, G and B brilliance signals to the C, M and Y density signals. Numeral 206 denotes a known masking and UCR circuit which outputs one of Y, M, C and Bk signals of a predetermined bit length, for example, 8-bit length, as a signal V1 from the input Y, M and C three principal color signals each time they are read. Numeral 207 denotes a selector unit for selecting an image signal to be recorded, and it selects one of the CCD read image signal V1 and an image signal V2 from an external equipment 219 at any timing. Numeral 208 denotes a gamma correction unit for recording the image with a desired density/tonality in compliance with the characteristic of the printer. Numeral 209 denotes a laser drive unit which converts the digital image signal to a pulse-modulated analog signal to drive the laser. Numeral 217 denotes a CPU which controls a motor 221 for reciprocally driving the optical system comprising the lamp 32 and the mirrors 35 and 36 through a motor driver 216, and controls the intensity and the turn on/off of an original illumination lamp 32 through a CVe 214, and controls the operation panel 213 through an I/O unit 212. The CPU includes known devices such as RAM and ROM. A communication control unit 211 communicates with the motor driver 216 and the external equipment 219. The external equipment receives form size and color mode information for recording the image signal and record start/stop commands and informs status of the reader unit and the printer unit. Numeral 210 denotes a synchronization signal generation unit which generates a pixel clock CLK1 for each pixel, line synchronization signals HSYNC1 and HSYNC2, and page synchronization signals PSYNC1 and PSYNC2. The PSYNC2 is applied to the image from the CCD, that is, the local copy operation. The PSYNC2 is applied to the image signal from the external equipment, that is, the remote print operation. Numeral 220 denotes a rate converter unit for converting an image signal V2' sent in synchronism with the pixel clock CLK2 from the external equipment and the one-line image effective interval signal LE to an image signal V2 which is in synchronism with the internal pixel clock CLK1 and the line synchronization signal HSYNC1.

The counter 215 has three counters for counting the CPU-CLK from the CPU to generate interrupt signals TM1-INT, TM2-INT and TM3-INT to the CPU 217 and the motor driver 216. The interrupt signals are used for the drive control timing of the optical system, the lamp control timing and the image formation start/stop timing.

Figure 3:
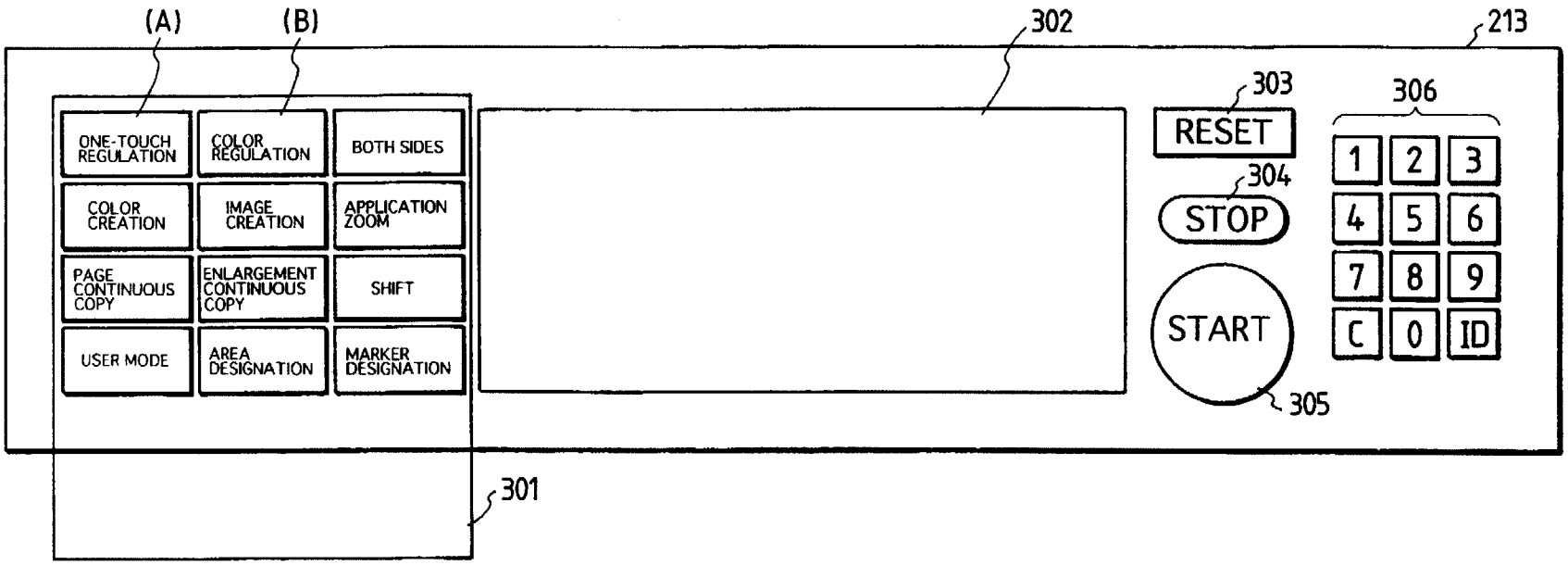
FIG. 3 shows an operational panel (a console panel).

FIG. 3 shows a detail of the operation panel 213. Numeral 301 denotes key means for setting application functions such as color adjustment. In the present embodiment, a one-touch adjustment key (regulation key) (A) and a color adjustment key (regulation key) (B) are explained later and the explanation of other functions is omitted. Numeral 302 denotes a liquid crystal panel of dot matrix type and it has a transparent touch panel on a surface thereof. Numeral 303 denotes a reset key which is pushed when the copy mode is to be reset to standard. Numeral 304 denotes a stop key which is pushed when the copy operation is to be stopped. Numeral 306 denotes a ten-key which is pushed to set a numeral such as the number of copies, a clear key (C) to reset to an initial value and an ID key to register a secret number.

Figure 4:
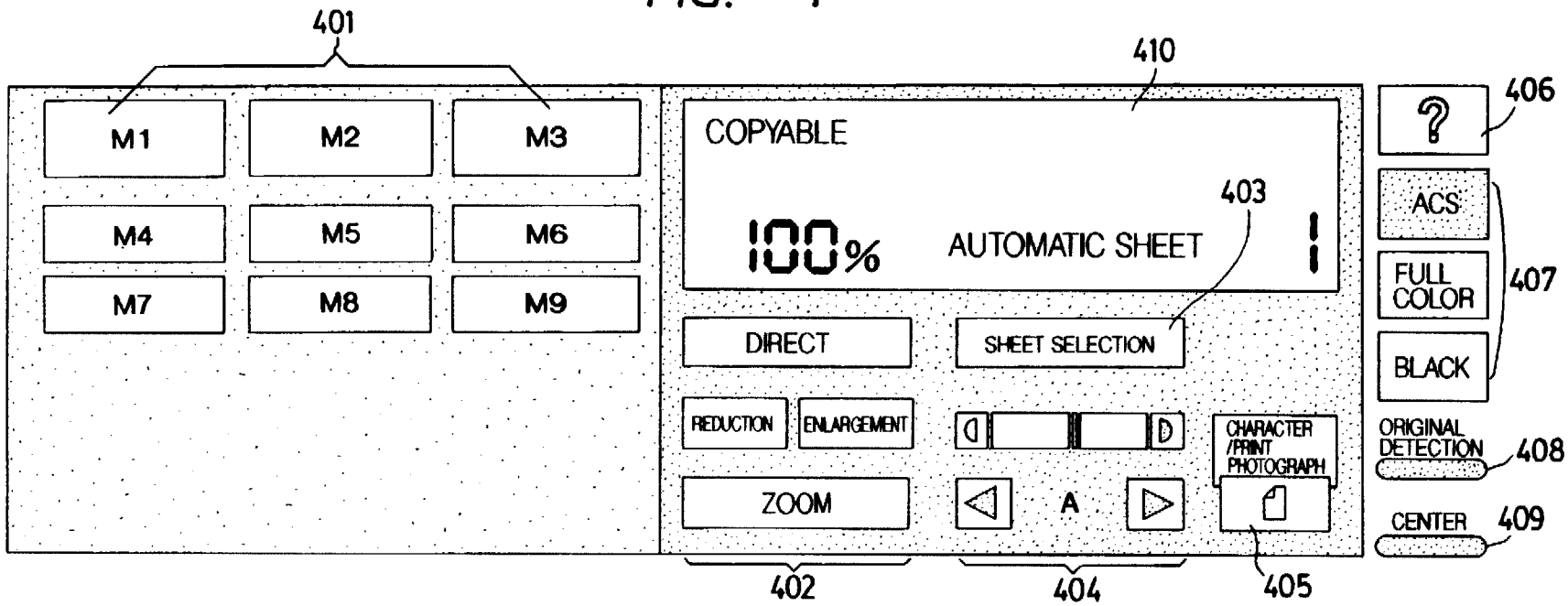
FIG. 4 shows a basic image screen of a liquid crystal touch panel.

FIG. 4 shows a basic screen displayed on the liquid crystal panel 302 when the reset key 303 is depressed. Nine soft keys M1 to M9 shown in 401 are mode memory keys for registering copy modes. "DIRECT", "REDUCTION", "ENLARGEMENT" and "ZOOM" shown in 402 are soft keys for setting a magnification factor and a magnification value corresponding to the setting is displayed thereabove. A form select key 403 is depressed when a sheet feed stage is to be selected and a selected size is displayed thereabove. Three keys in 404 are soft keys for selecting a density. When a key A is inversely displayed, the machine detects the density of the original and automatically adjusts the density. A key 405 is used to select an optimum process for the type of original such as an original having characters and photographs mixed, an original of only characters and an original of only photographs. A "?" key 406 is a help key which is used to describe the function or method for setting. Three keys "ACS", full color and black in 407 are soft keys for selecting colors to be copied. When the key ACS is inversely displayed, the machine detects the color of the original and automatically determines whether it is a black and white sheet or a color sheet. An original detect key 408 is selected when the position and the size of the original mounted on the original supporting glass are to be automatically detected. A center key 409 is selected when the copying is to be made at the center of the sheet. The display 410 is used to display the magnification, the sheet size as well as the status of the machine and the number of sheets.

Figure 5:
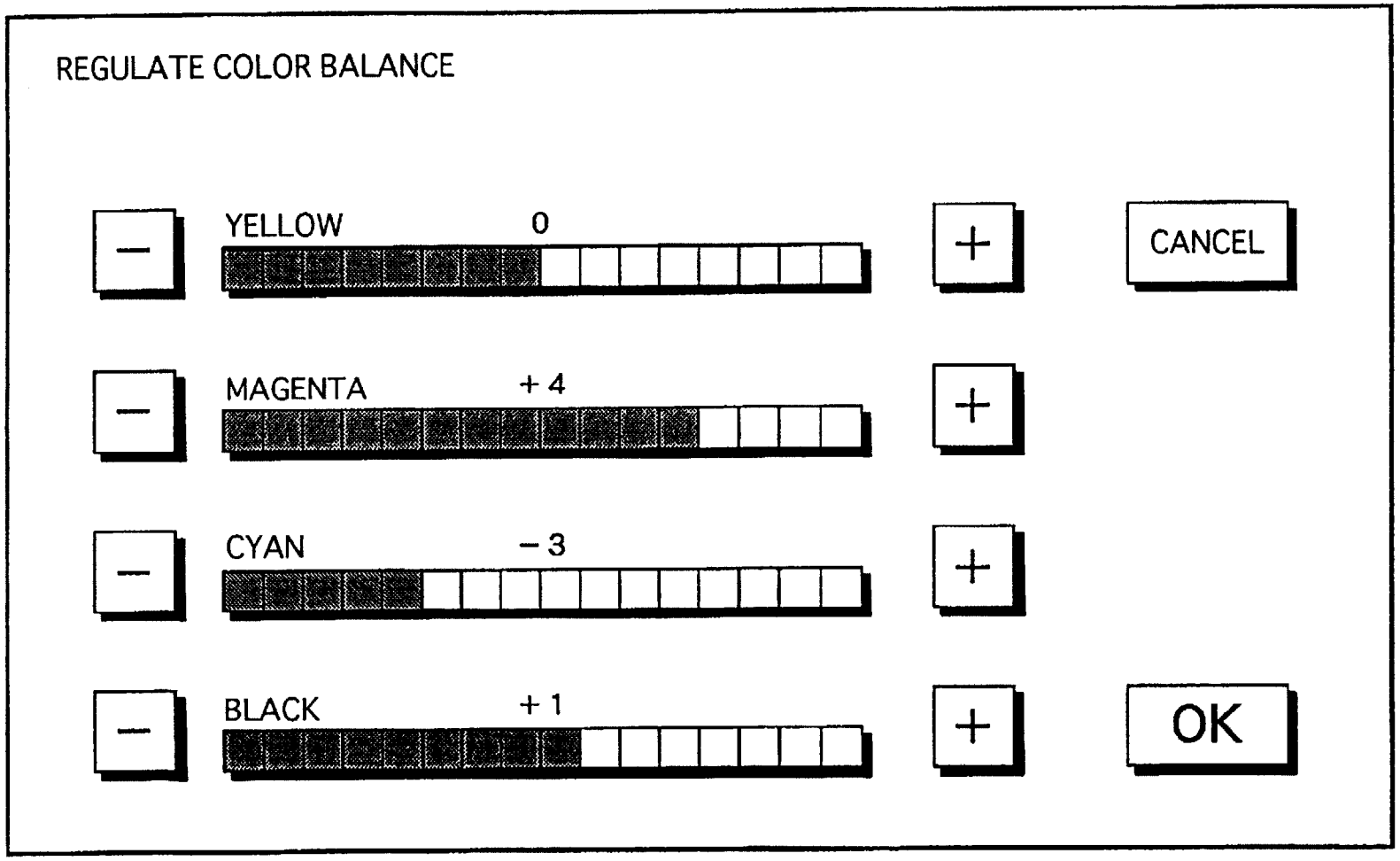
FIG. 5 shows a color adjustment screen.
Figure 6A:
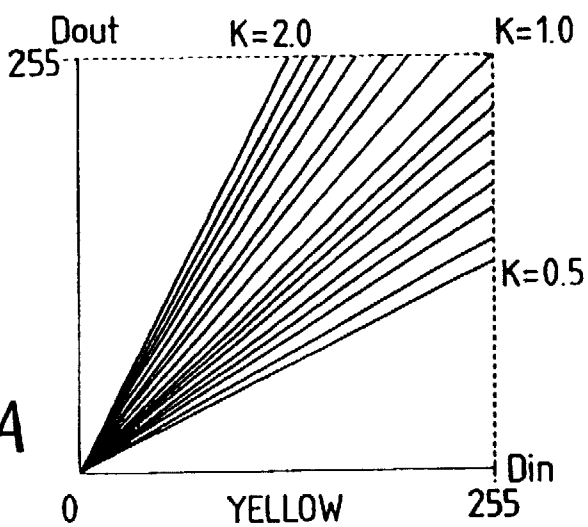
FIG. 6 shows a gamma correction table.
Figure 6B:
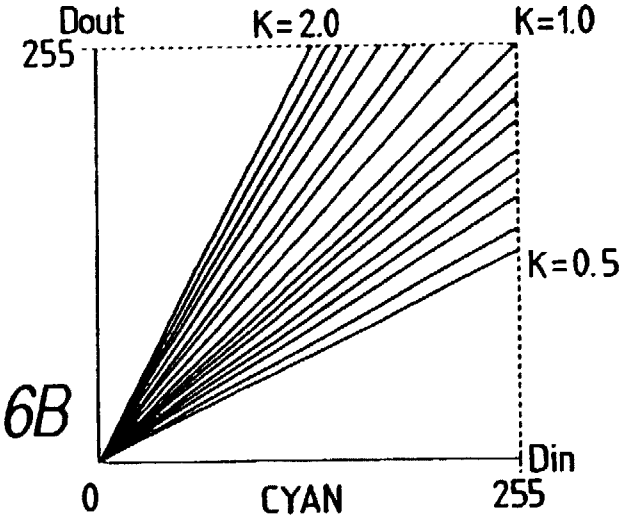
Figure 6C:
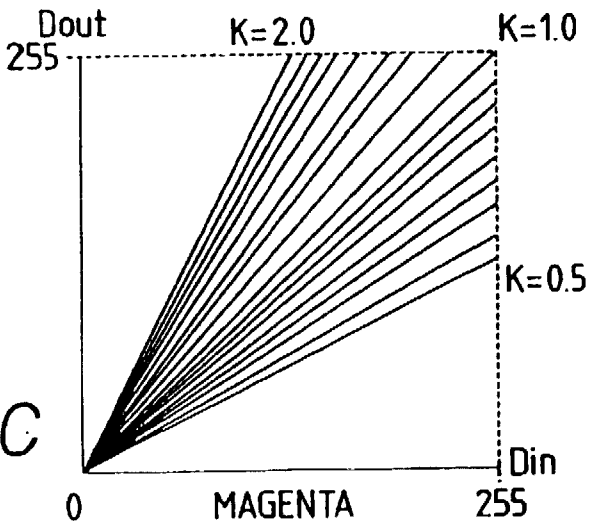
Figure 6D:
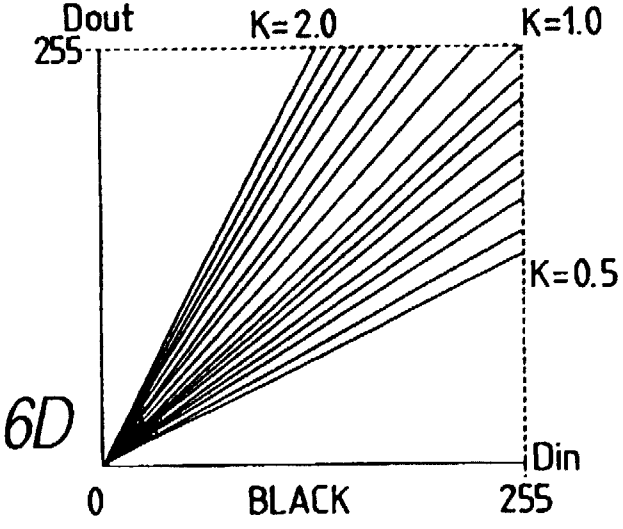

FIG. 5 shows a left half of a screen of the liquid crystal panel 302 when the color adjustment key (B) in FIG. 3 is depressed. Adjustment may be made in 17 steps, from plus 8 to minus 8 for each of the four developing colors yellow (Y), magenta (M), cyan (C) and black (Bk). The corresponding bar indication increases by a +key and decreased by a −key. When the setting is to be cancelled, a cancel key is depressed to return to the basic screen and an OK key is depressed when the setting is acceptable. The setting of the color balance is reflected to the gamma correction block 208 of FIG. 2B.

Figure 7:
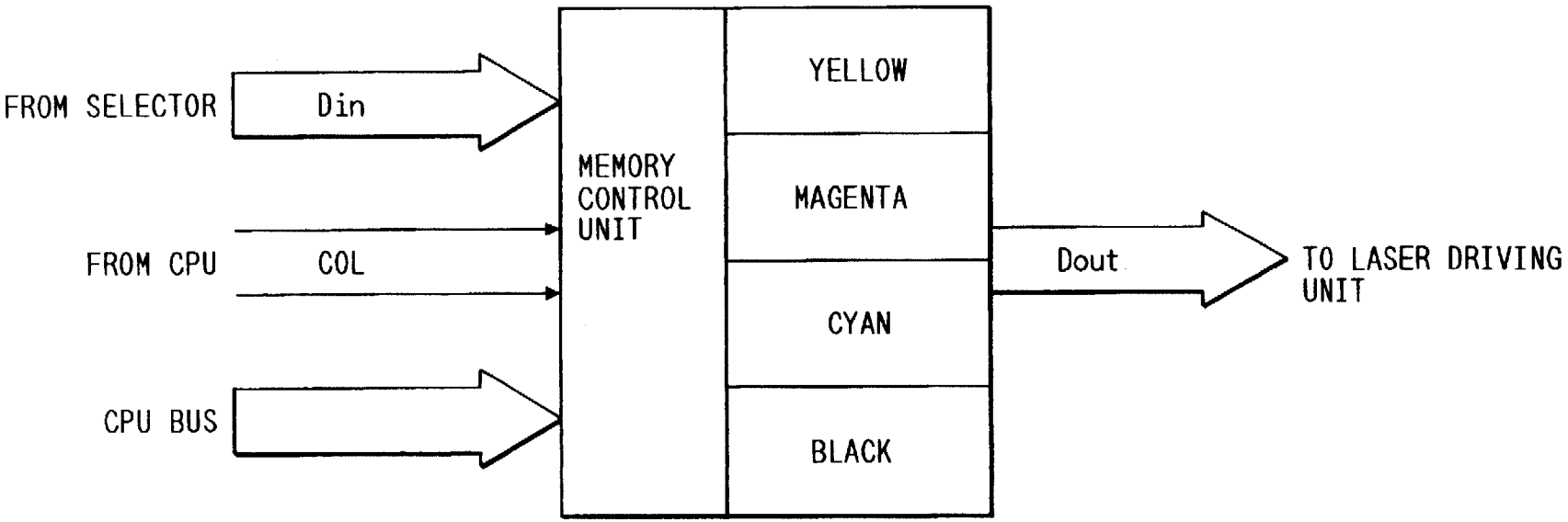
FIG. 7 shows a gamma correction block.

Referring to FIG. 7, the gamma correction block 208 is explained. The gamma correction block comprises a lookup table which comprises a RAM corresponding to the respective developing color agents. When input image data Din and output image data Dout are 8-bit data, a capacity of 256 bytes are required for each color. When an area is specified by a digitizer (not shown) and the gamma is selected for each area of the original, as many table as the number of types of selection are required for each color. Data is written to the table through the CPU. When the image is outputted, the memory control unit switches the address to the RAM from the CPU bus to the image data Din and the control signal COL to output the image data Dout. The CPU 2 selects one of four colors at the image formation timing by the 2-bit port output COL.

FIG. 6 shows a relation between the color balance setting and the content of the gamma correction table. In the present example, the correction table is linear and only the gradient K thereof changes in accordance with the color balance. When the setting is "0", K=1.0, when it is +8, K=2.0 and when it is −8, K=0.5. For other settings, K is an appropriate intermediate value.

Figure 8:
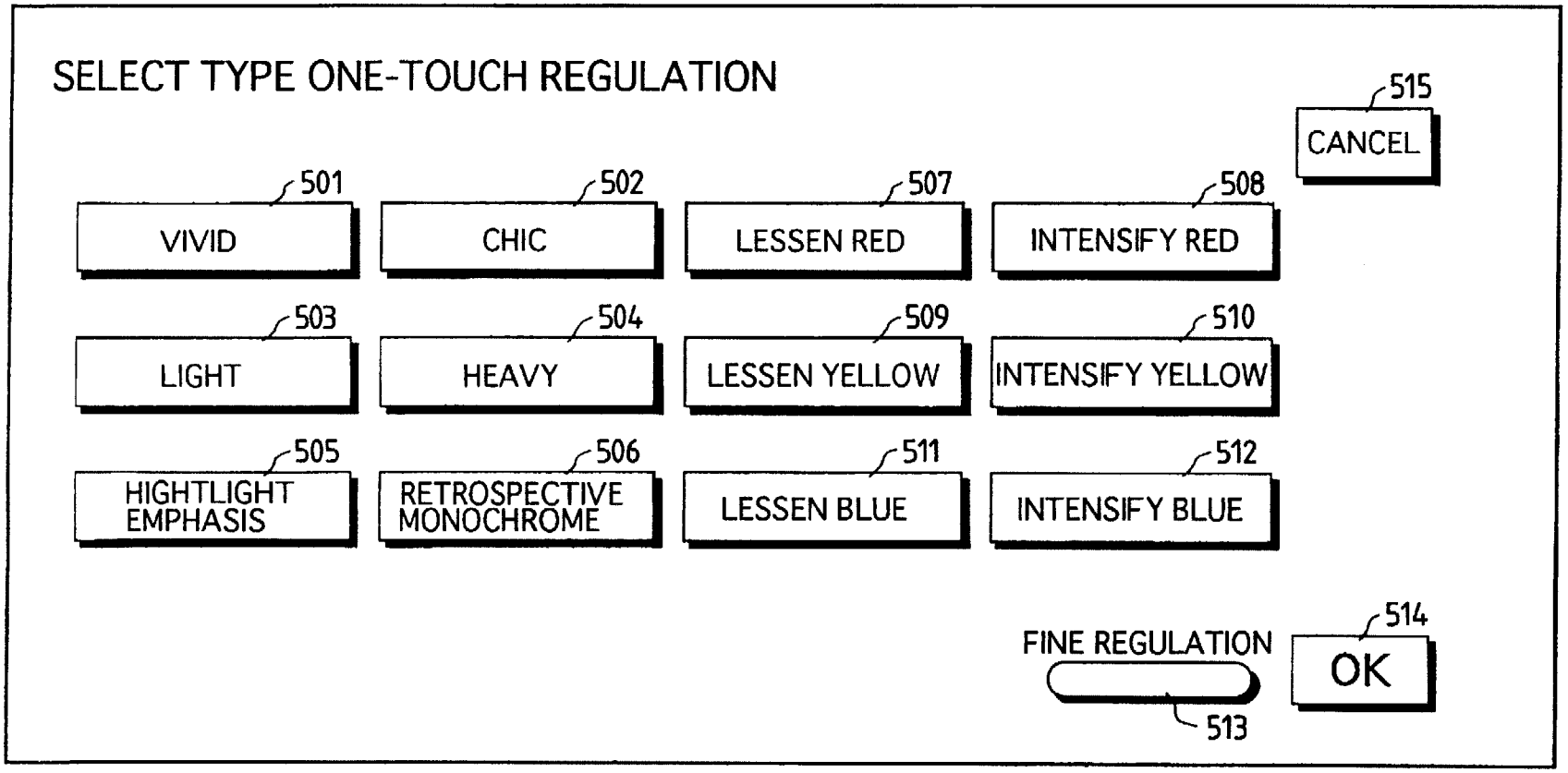
FIG. 8 shows a one-touch adjustment screen.
Figure 13:
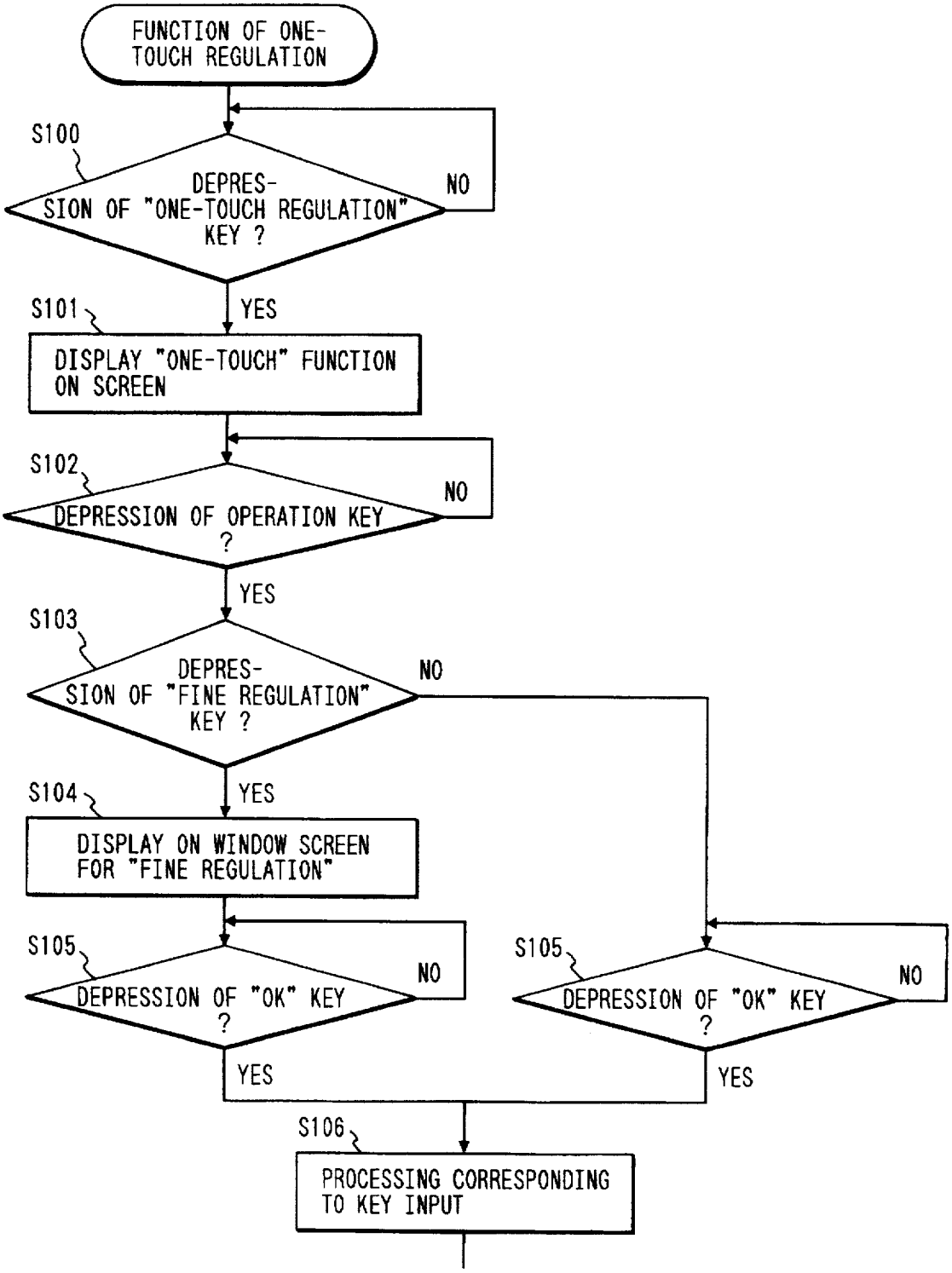
FIG. 13 shows a flow chart of a process in the one-touch adjustment.

FIG. 8 shows a screen of the "one-touch adjustment" in the present embodiment. Referring to FIG. 13, a flow of process is explained. The one-touch adjustment screen is displayed on the liquid crystal panel 302 by depressing the one-touch adjust key (A) of FIG. 3 (FIG. 13, S100, S101). When "lessen red", "intensify red", "lessen yellow", "intensify yellow", "lessen blue" or "intensify blue" key 507–512 of the operation key 501–512 of the screen of the one-touch adjust function is selected, the gamma correction table as shown in FIG. 10 is set to the gamma correction block 208. For example, when intensify red is selected, the gradient of magenta (M) and yellow is K=1.25 and the gradient of cyan (C) and black (Bk) is K=1.0. The gradient setting is made by experience. After the depression of the desired "operation keys" 501–512 (FIG. 13, S102), the "OK" key 514 is depressed if the setting is OK (FIG. 13, S105) so that the process corresponding to the key input is carried out (FIG. 13 S106). Thus, by providing the key input means having a plain expression indicating the effect of the image processing such as "enhance red" and associating them to appropriate adjustment values, the color adjustment can be attained without knowing the mechanism of the color image formation and the terms of magenta, yellow and cyan, and the adjustment is attained by a very simple one-touch manipulation of depressing a single key.

A function to further finely adjust the key input process by the one-touch adjustment (for example, a function to further intensify or lessen (enhance or suppress) to the "enhance red" function) is explained below.

Figure 9:
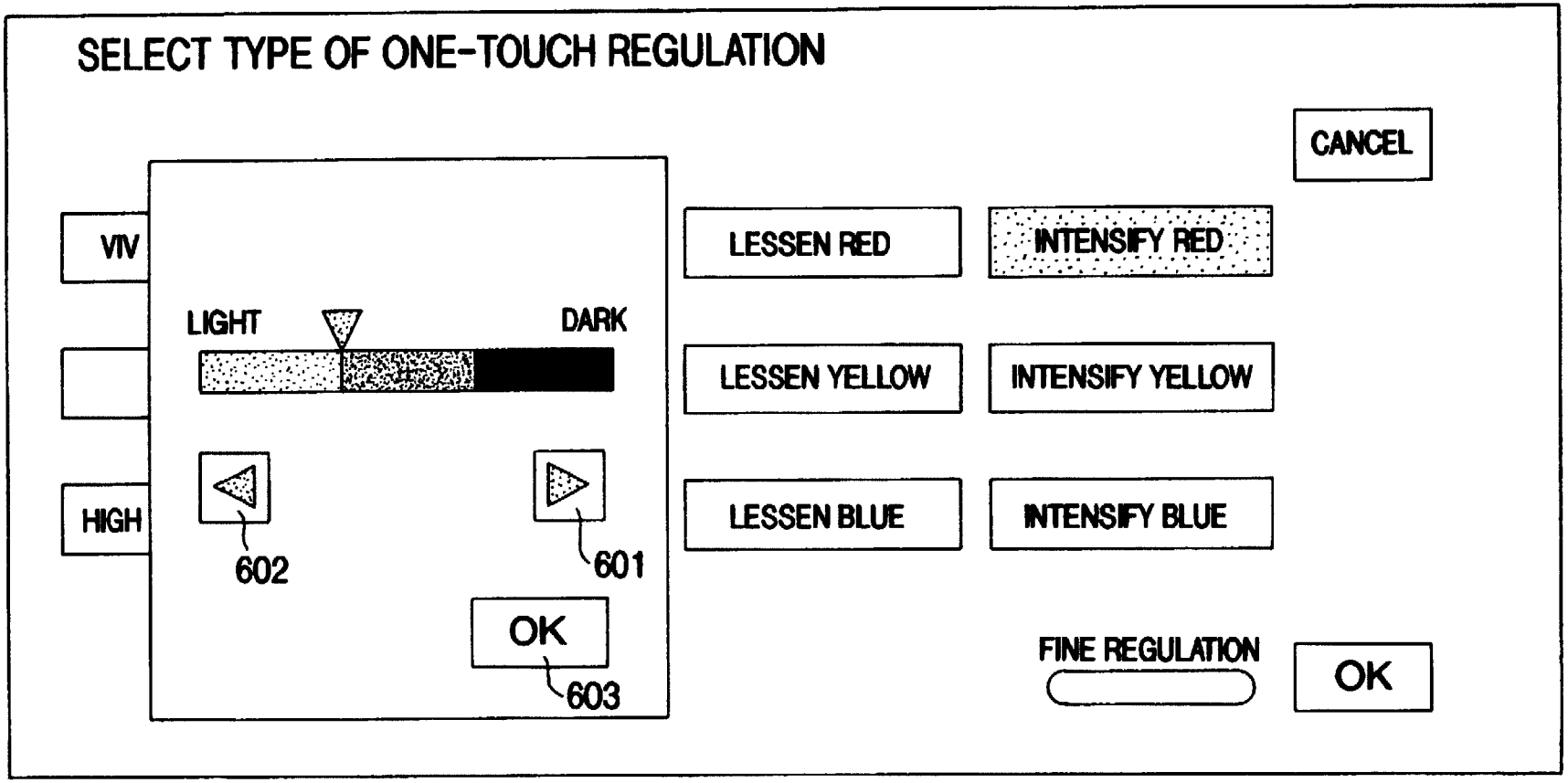
FIG. 9 shows a fine adjustment screen of the one-touch adjustment.
Figure 10A:
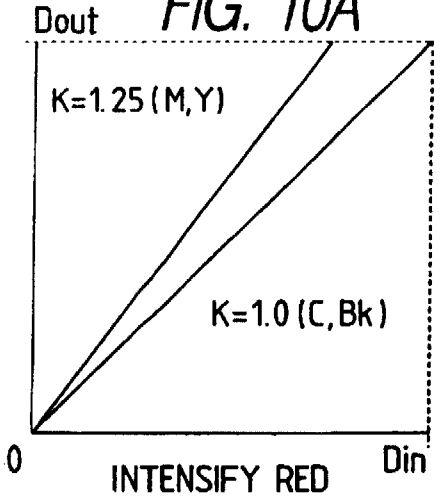
FIG. 10 shows a relation between the one-touch adjustment and the gamma correction table.
Figure 10B:
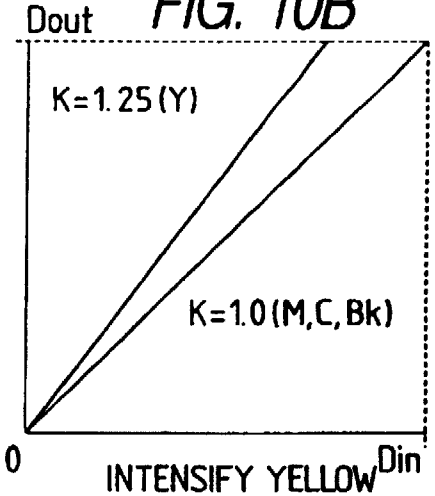
Figure 10C:
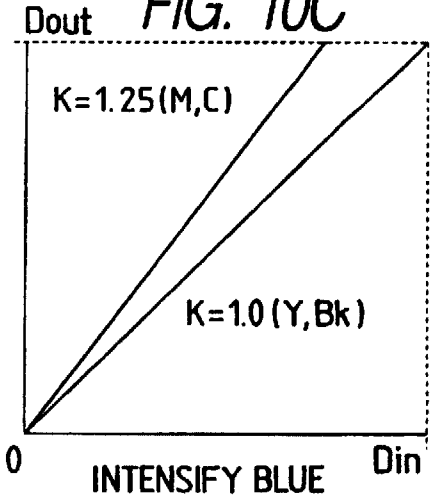
Figure 10D:
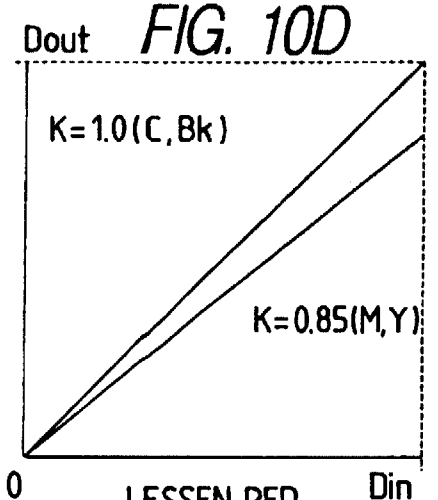
Figure 10E:
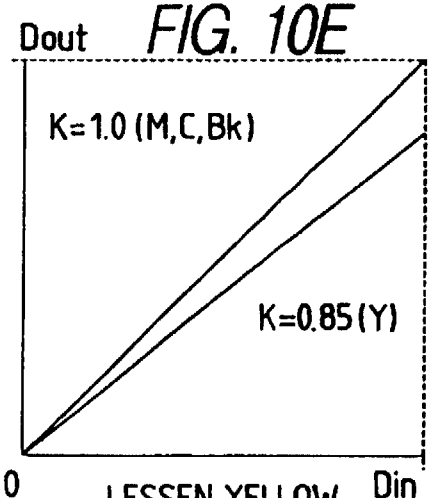
Figure 10F:
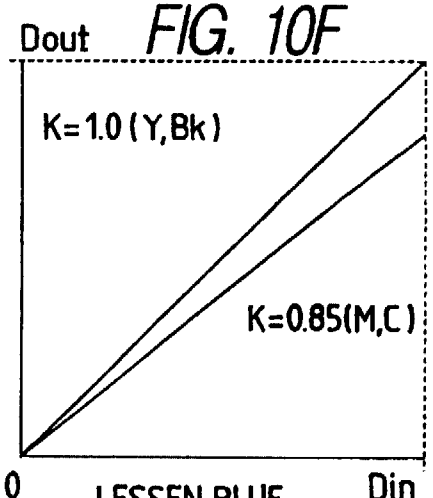
Figure 11:
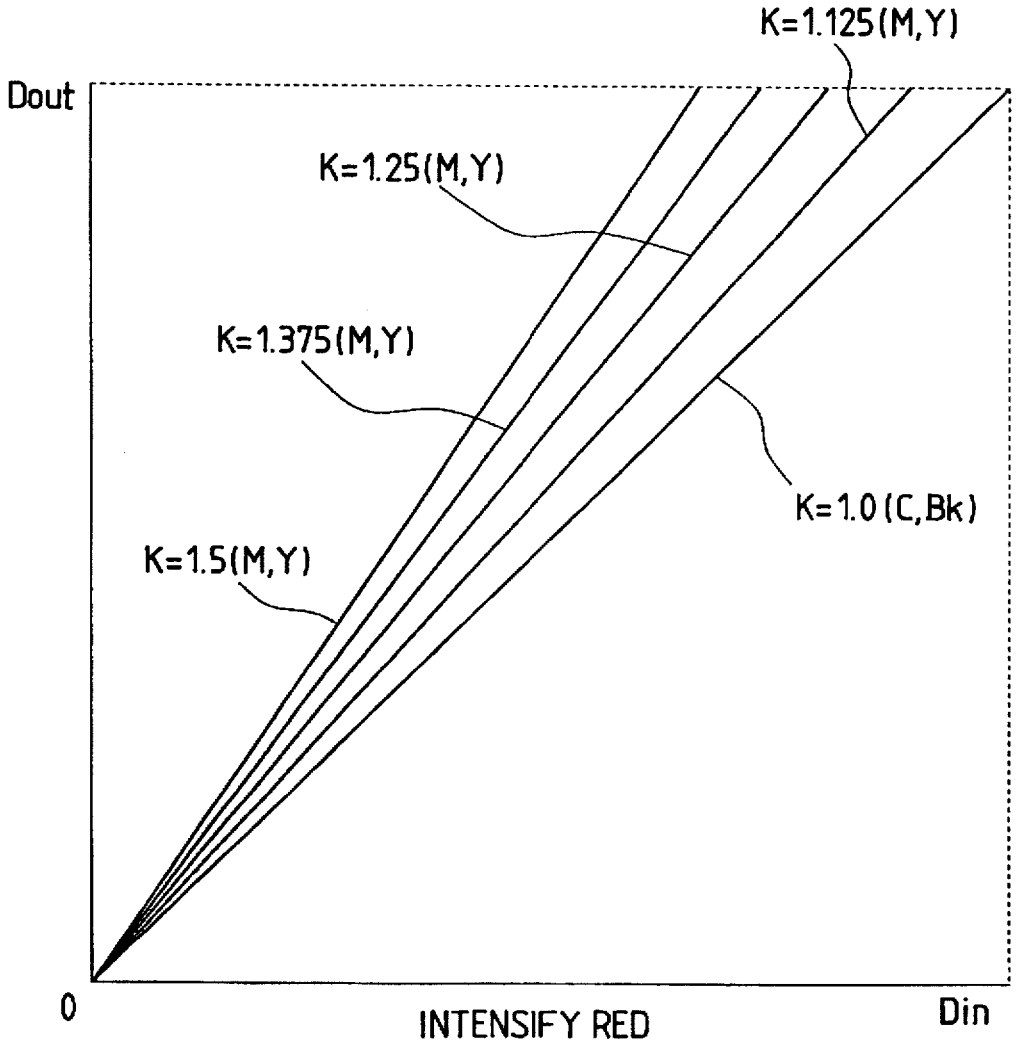
FIG. 11 shows a gamma correction table for the fine adjustment of the one-touch adjustment.

In FIG. 8, after the enhance red key 508 is selected, a fine adjust key 513 is depressed as required (FIG. 13, S103). As shown in FIG. 9, a window screen for the fine adjustment is displayed (FIG. 13, S104) and the degree of the intensity of red can be finely adjusted by an "UP" key 601 and a "DOWN" key 602. For example, when the "fine adjust" is selected for the "intensify red", the fine adjustment of the gamma correction table is attained one step decrement (for example, the gradient K=1.125) with reference to the gradient K=1.25 of magenta (M) and yellow (Y) and two step increments (for example, the gradient K=1.375, 1.5) as shown in FIG. 11. If the setting is OK, the "OK" key 603 is depressed (FIG. 13, S105) and the process corresponding to the key input is carried out. When wrong key input is made in the one-touch adjust process, the cancel key 515 is depressed to cancel the wrong input. In the color adjustment mechanism shown in FIG. 5, any of Y, M, C and Bk level adjustments can be attained on one screen so that it is easy to use for a person who is familiar with the function and since it is also possible to adjust the degree of red intensity by considering only red, for example, in the one-touch adjustment of FIG. 9, a person who is unfamiliar with the color processing can readily adjust the color by using this function. Since the display is made on multi-windows, the risk of misoperation is eliminated.

The present embodiment has the adjustment means which is easy to understand to the user of any level and provides the high operability and usability.

Figure 12A:
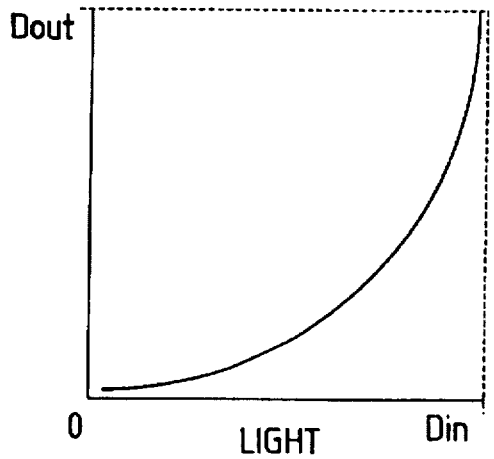
FIG. 12 shows a relation between another gamma correction table and one-touch adjustment.
Figure 12B:
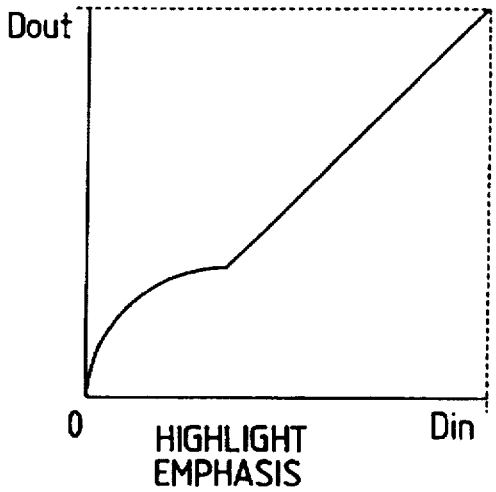
Figure 12C:
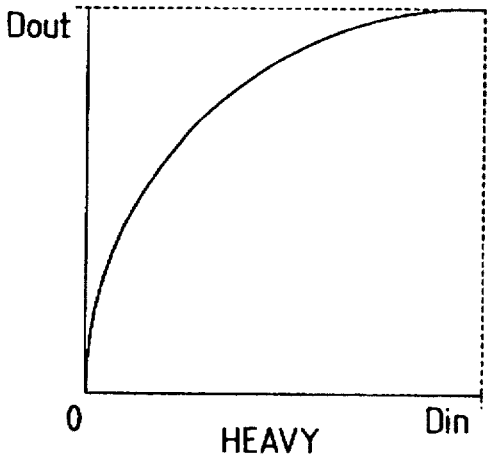

Other one-touch adjustment mode shown in FIG. 8 is explained. In the above explanation of the present embodiment, the linear gamma correction process is used. When a non-linear gamma curve as shown in FIG. 12 is included in the one-touch adjustment item, it is more effective. "LIGHT" slightly suppresses the density to finish in a light touch, and "HEAVY" slightly enhances the density to impart a heavy feeling. "ENHANCE HIGHLIGHT" enhances the density of a highlighted area which is normally too light to view to finish it with easy-to-view tone. Such a non-linear curve is difficult to specify from a panel of the reproducing apparatus and it is hard to recognize which gamma correction curve is effective to the desired finish. In the present embodiment, the key input means having the easy-to-recognize expression indicating the degree of finish of the copy output, that is, the effect of the image processing are provided so that everyone can fully use the high function.

As described above, according to the present invention, since the plurality of image processing menus are displayed by modifying words representing the contents of image processing, the image processing can be readily accomplished even by a user who is unfamiliar with the image processing and the apparatus is of high operability and usability. Further, since the adjustment can be made within the selected image processing menu, the apparatus with the high operability is provided.

It should be understood that the present invention is not limited to the preferred embodiments but various modifications may be made without departing from the scope of the claims.

What is claimed is:

1. An image processing apparatus comprising:

first display means for concurrently displaying a plurality of image processing menus for selecting a type of image processing, said plurality of image processing menus including modifying words representing contents of image processing;

second display means for displaying a screen used for adjusting the image processing selected from the plurality of image processing menus displayed by said first display means;

determining means for determining whether said second display means is activated; and image processing means (1) for effecting image processing in accordance with the image processing selected from said plurality of image processing menus when said second display means is determined not to be activated, and (2) for effecting image processing adjusted in accordance with an adjustment state displayed by said second display means when said second display means is determined to be activated, wherein said adjustment state represents at least a degree of the image processing selected from the plurality of image processing menus displayed by the first display means, and wherein said first and second display means are displayed in multiple windows.

2. An image processing apparatus according to claim 1, wherein said second display means displays the adjustment state after the selection of the menu.

3. An image processing apparatus according to claim 1, wherein said first and second display means are touch-panels.

4. An image processing apparatus according to claim 1, wherein said first display means for displaying the image processing menus is shared by a key input unit, and said image processing means processes an image in accordance with an input from said key input unit.

5. An image processing apparatus according to claim 1, further comprising gamma correction table data for the plurality of image processing menus, wherein said image processing apparatus processes an image in accordance with a predetermined gamma correction table data in accordance with the selection of the image processing menu.

6. A copying apparatus comprising:

first display means for concurrently displaying a plurality of image processing menus for selecting a type of image processing, said plurality of image processing menus including modifying words representing a finished degree image processing;

second display means for displaying a screen used for adjusting the image processing selected from the plurality of image processing menus displayed by said first display means;

determining means for determining whether the second display means is activated;

image processing means for effecting image processing in accordance with the image processing selected from said plurality of image processing menus, or for effecting image processing adjusted in accordance with an adjustment state displayed by said second display means, the image processing means effecting the image processing in accordance with a determination from said determining means, wherein said adjustment state represents at least a degree of the image processing selected from the plurality of image processing menus displayed by the first display means, and wherein the first and second display means are displayed in multiple windows.

7. A copying apparatus according to claim 6, wherein said second display means displays the adjustment state after the selection of the menu.

8. A copying apparatus according to claim 6, wherein said first and second display means are touch-panels.

9. A copying apparatus according to claim 6, wherein said first display means for displaying the image processing menus is shared by a key input unit, and said image processing means processes an image in accordance with an input from said key input unit.

10. A copying apparatus according to claim 6, further comprising gamma correction table data for the plurality of image processing menus, wherein said image processing means processes an image in accordance with a predetermined gamma correction table data in accordance with the selection of the image processing menu.

11. A color image forming apparatus comprising:

first display means for displaying a menu having different plural types of image processing functions;

second display means for displaying an adjustment screen for setting a degree of processing of an image processing function selected from said plural types of image processing functions, the degree of processing being set using one parameter;

indicating means for indicating activation of said second display means; and image processing means for, when there is no indication of activation by the indicating means, (1) effecting image processing in accordance with the image processing function selected from said plural types of image processing functions, and (2) not effecting display of the second display means, wherein said plural types of image processing functions are each defined by a combination of a plurality of processing parameters, and wherein each combination of the plurality of the processing parameters is changed by setting a degree of said one parameter.

12. A color image forming apparatus according to claim 11, wherein said color image forming apparatus is a color copying apparatus.

13. An image processing method comprising:

a first displaying step of concurrently displaying, in a first display means, a plurality of image processing menus for selecting a type of image processing, said plurality of image processing menus including modifying words representing contents of image processing;

an indicating step of indicating activation of a second display means;

a second displaying step of displaying, in the second display means, a screen used for adjusting the image processing selected from the plurality of image processing menus displayed in said first displaying step, the second displaying step displaying the second display means when the indicating step indicates activation of the second display means; and an image processing step for, when the indicating step does not indicate activation of the second display means, effecting image processing in accordance with the image processing selected from the plurality of image processing menus, wherein an adjustment state displayed in the second display means represents a degree of the image processing selected from the plurality of image processing menus displayed by the first display means.

14. A copying method comprising:

a first displaying step of concurrently displaying, in a first display means, a plurality of image processing menus for selecting a type of image processing, the plurality of image processing menus including modifying words representing a finished decree of image processing;

an indicating step for indicating activation of a second display means;

a second displaying step of displaying, in the second display means, a screen used for adjusting the image processing selected from the plurality of image processing menus displayed in said first displaying step, the second displaying step displaying the second display means when the indicating step indicates activation of the second display means; and an image processing step for, when the indicating step does not indicate activation of the second display means, effecting image processing in accordance with the image processing selected from the plurality of image processing menus, wherein an adjustment state displayed in the second displaying means represents a degree of the image processing selected from the plurality of image processing menus displayed by the first display means.

15. A color image forming method comprising:

a first displaying step of displaying, in a first display means, a menu having different plural types of image processing functions;

an indicating step of indicating activation of a second display means;

a second displaying step of displaying, in the second display means, an adjustment screen for setting a degree of processing of an image processing function selected from said plural types of image processing functions, the degree of processing being set using one parameter, and the second displaying step displaying the second display means when the indicating step indicates activation of the second display means; and an image processing step for, when there is no indication of activation by said indicating means, effecting image processing in accordance with the image processing function selected from said plural types of image processing functions, wherein said plural types of image processing functions are each defined by a combination of a plurality of processing parameters, and wherein each combination of the plurality of the processing parameters is changed by setting a degree of said one parameter.

16. A color image forming method according to claim 15, wherein said color image forming method is a color copying method.

17. An image processing apparatus for performing color adjustment processing on a color image represented by an image signal comprised of a plurality of color components, comprising:

indication means for selectively indicating a first color adjustment mode in which an adjustment state is set for each of the color components in the image signal, and a second color adjustment mode in which the adjustment state is set by indicating a modifying word representing contents of the color adjustment processing;

display means for generating a display on a display unit for setting the adjustment state corresponding to the first color adjustment mode, or for generating a display on the display unit for displaying the modifying word corresponding to the second color adjustment mode which represents the contents of the color adjustment processing, the display means generating a display in response to an indication by the indication means;

guide means for displaying a letter guide for the first color adjustment mode or a letter guide for the second color adjustment mode, the guide means displaying a letter guide in response to an indication by the indication means; and image processing means for performing image processing corresponding to a user's setting on the display unit based on the indication means.

18. An apparatus according to claim 17, wherein the plurality of color components include yellow, magenta and cyan.

19. An apparatus according to claim 18, wherein the image processing apparatus is a copying apparatus.

20. An apparatus according to claim 17, wherein the modifying word relates to sensitivity.

21. An apparatus according to claim 20, wherein the image processing apparatus is a copying apparatus.

22. An apparatus according to claim 17, wherein the display unit is a liquid crystal display.

23. An apparatus according to claim 22, wherein the image processing apparatus is a copying apparatus.

24. An apparatus according to claim 17, wherein the indication means comprises a touch panel and the user's setting is set by touching the touch panel.

25. An apparatus according to claim 24, wherein the image processing apparatus is a copying apparatus.

26. An apparatus according to claim 17, wherein the image processing apparatus is a copying apparatus.

27. An apparatus according to claim 17, further comprising fine adjustment means for finely adjusting a degree of the adjustment state set in the second color adjustment mode.

28. An image processing apparatus comprising:

first display means for concurrently displaying a plurality of image processing menus for selecting a type of image processing, the plurality of image processing menus including modifying words representing contents of image processing;

second display means for displaying a screen used for adjusting the image processing selected from the plurality of image processing menus displayed by the first display means;

indicating means for indicating activation of the second display means; and image processing means for, when the indicating means does not indicate activation of the second display means, (1) effecting image processing in accordance with the image processing selected from the plurality of image processing menus, and (2) not displaying the second display means, wherein an adjustment state displayed in the second display means represents a degree of the image processing selected from the plurality of image processing menus displayed by the first display means.

29. A copying apparatus comprising:

first display means for concurrently displaying a plurality of image processing menus for selecting a type of image processing, the plurality of image processing menus including modifying words representing a finished degree of image processing;

second display means for displaying a screen used for adjusting the image processing selected from the plurality of image processing menus displayed by the first display means;

indicating means for indicating activation of the second display means; and image processing means for, when the indicating means does not indicate activation of the second display means, (1) effecting image processing in accordance with the image processing selected from the plurality of image processing menus, and (2) not displaying the second display means when the indicating means does not indicate activation of the second display means, wherein an adjustment state displayed in the second display means represents a degree of the image processing selected from the plurality of image processing menus displayed by the first display means.

* * * * *

UNITED STATES PATENT AND TRADEMARK OFFICE

CERTIFICATE OF CORRECTION

PATENT NO. : 5,754,924

DATED : May 19, 1998

INVENTOR : Masanori Yamada

It is certified that error appears in the above-identified patent and that said Letters Patent is hereby corrected as shown below:

On the title page, item [56]

References Cited

U.S. PATENT DOCUMENTS

| | | |
|---|---|---|
| "5,493,349 | 2/1996 | Ikeda" should read |
| --5,495,349 | 2/1996 | Ikeda--. |

FOREIGN PATENT DOCUMENTS

| | | |
|---|---|---|
| "3123274 | 5/1991 | Japan" should read |
| --3-123274 | 5/1991 | Japan--. |

Please insert:

| | | |
|---|---|---|
| --1-152477 | 6/1989 | Japan--. |

FIG. 8 --; in the drawings--

Element 505 "HIGHTLIGHT" should read --HIGHLIGHT--.

UNITED STATES PATENT AND TRADEMARK OFFICE

CERTIFICATE OF CORRECTION

PATENT NO. : 5,754,924

DATED : May 19, 1998

INVENTOR : Masanori Yamada

It is certified that error appears in the above-identified patent and that said Letters Patent is hereby corrected as shown below:

COLUMN 2

Line 50, "(a" should read --a--.

COLUMN 4

Line 24, "CVe 214," should read --CVR 214,--.

COLUMN 7

Line 63, "degree" should read --degree of--.

COLUMN 9

Line 20, "decree" should read --degree--.

Signed and Sealed this

Twenty-seventh Day of July, 1999

*Attest:*

Q. TODD DICKINSON

*Attesting Officer*

*Acting Commissioner of Patents and Trademarks*